US009099264B2

(12) United States Patent
Shedletsky et al.

(10) Patent No.: US 9,099,264 B2
(45) Date of Patent: Aug. 4, 2015

(54) ANTI-ROTATIONAL BUTTONS

(75) Inventors: Anna-Katrina Shedletsky, Sunnyvale, CA (US); Colin M. Ely, Cupertino, CA (US); Phillip Michael Hobson, Menlo Park, CA (US)

(73) Assignee: APPLE INC., Cupertino, CA (US)

( * ) Notice: Subject to any disclaimer, the term of this patent is extended or adjusted under 35 U.S.C. 154(b) by 148 days.

(21) Appl. No.: 13/607,541

(22) Filed: Sep. 7, 2012

(65) Prior Publication Data

US 2014/0069782 A1 Mar. 13, 2014

(51) Int. Cl.

| | |
|---|---|
| ***H01H 9/00*** | (2006.01) |
| ***H01H 19/62*** | (2006.01) |
| ***H01H 27/00*** | (2006.01) |
| ***H01H 13/50*** | (2006.01) |
| ***H01H 11/00*** | (2006.01) |
| ***H01H 13/14*** | (2006.01) |
| ***H01H 13/705*** | (2006.01) |

(52) U.S. Cl.

CPC ..... *H01H 13/50* (2013.01); *H01H 11/00* (2013.01); *H01H 13/14* (2013.01); *H01H 13/705* (2013.01); *H01H 9/00* (2013.01); *H01H 2221/026* (2013.01); *H01H 2221/058* (2013.01); *Y10T 29/49105* (2015.01)

(58) Field of Classification Search

CPC ..... H01H 1/46; H01H 2201/006; H01H 2203/058; H01H 2205/018; H01H 2205/02; H01H 2233/012; H01H 2300/042; H01H 9/00; H01H 19/62; H01H 27/00; H01H 1/00; H01H 1/12; H01H 3/12; H01H 3/122; H01H 3/16; H01H 9/02; H01H 13/00; H01H 13/04; H01H 13/14; H01H 13/50; H01H 2003/12; H01H 2003/145; H01H 2013/00; H01H 2013/50; H01H 2021/00; H01H 2021/18; H01H 2021/22; H01H 2021/24; H01H 2201/01; H01H 2221/00; H01H 2221/052; H01H 2221/05; H01H 2221/09; H01H 2223/00; H01H 2231/02; H01H 2233/00; H01H 2223/012; H01H 2233/032; H01H 2233/052; H01H 2233/072; H01H 2233/092; H01H 2237/006; H01H 2237/008; H01H 2239/02

USPC ..... 200/5 R, 5 A, 510, 511, 520–522, 200/537–539, 548, 329, 341, 343, 345, 17 R

See application file for complete search history.

(56) References Cited

U.S. PATENT DOCUMENTS

| | | | | |
|---|---|---|---|---|
| 4,453,052 | A * | 6/1984 | Semian et al. | 200/85 R |
| 6,910,439 | B2 * | 6/2005 | Baba et al. | 116/62.3 |
| 7,795,553 | B2 * | 9/2010 | Weber et al. | 200/341 |

* cited by examiner

*Primary Examiner* — Edwin A. Leon
*Assistant Examiner* — Anthony R. Jimenez
(74) *Attorney, Agent, or Firm* — Brownstein Hyatt Farber Schreck, LLP

(57) ABSTRACT

Systems and methods for providing input component assemblies with anti-rotational buttons in electronic devices are provided. The input component assembly includes a switch, a button positioned over the switch, where the button is operative to close at least one circuit of the switch when the button is depressed towards the switch, and at least one pin positioned underneath the button, where the at least one pin is operative to engage with a surface to assist in preventing rotation of the button, when the button is depressed towards the switch.

27 Claims, 6 Drawing Sheets

ANTI-ROTATIONAL BUTTONS

FIELD OF THE INVENTION

This can relate to systems and methods for providing input component assemblies in electronic devices and, more particularly, to systems and methods for providing input component assemblies with anti-rotational buttons in electronic devices.

BACKGROUND OF THE DISCLOSURE

Electronic devices often include one or more input component assemblies for allowing a user to interact with the electronic device and manipulate the functions available with the electronic device. In some cases, one or more switches can be provided underneath a physical input element, such as a button or a key, of an input component assembly on a device. The switch may be positioned under a button such that, when the button is pressed, the switch may close an electrical circuit. In particular, a switch can include a dome that is positioned over a contact pad such that, when the dome is deformed with the application of force (e.g., via a button), the dome comes into contact with the contact pad and closes a circuit.

During construction of the electronic device, care is taken to properly position the button over the one or more switches and within an opening through device housing. Specifically, the button may need to be positioned within a housing opening so that an icon or a symbol on the button is properly aligned relative to the other components of the device. For example, the button may need to be placed within the housing opening of the device to ensure that the icon appears straight and is not displayed upside down or slanted off to one side when viewed by a user of the device.

After construction of the device, users interact with the device by applying force to the buttons. The force may not be applied evenly across the button and, as a consequence, the force applied may cause the button to rotate with respect to the housing. Over time, the repeated application of force that rotates the button may cause the button to become dislodged, out of line with the switch underneath, and/or otherwise repositioned so that the icon is no longer correctly aligned.

Accordingly, there is a need to reduce the tendency for electronic device buttons to rotate.

SUMMARY OF THE DISCLOSURE

Systems and methods for providing input component assemblies with anti-rotational buttons in electronic devices are provided. In some embodiments, an input component assembly may include a switch, a button positioned over the switch, where the button is operative to close at least one circuit of the switch when the button is depressed towards the switch, and at least one pin positioned underneath the button, where the at least one pin is operative to engage with a surface to assist in preventing rotation of the button when the button is depressed towards the switch.

In other embodiments, an electronic device may include a housing having an opening, a surface fixed with respect to the housing, a button positioned in the opening, and at least one pin configured to engage with the surface and the button, where the at least one pin prevents rotation of the button in the opening when the at least one pin engages with the surface and the button.

In yet other embodiments, a method for forming an input component assembly for an electronic device may include positioning a button over a switch, where the button is operative to close at least one circuit of the switch when the button is depressed towards the switch, and positioning at least one pin underneath the button, where the at least one pin is operative to engage with a surface that defines a hole, and where engaging with a surface that defines a hole for preventing rotation of the button when the button is depressed towards the switch.

In yet other embodiments, an input component assembly may include a switch, and a button positioned over the switch. The button may be operative to close at least one circuit of the switch when the button is depressed towards the switch. The input component assembly may also include a first mechanical feature positioned underneath the button. The first mechanical feature may be operative to engage with a second mechanical feature to assist in preventing rotation of the button when the button is depressed towards the switch.

BRIEF DESCRIPTION OF THE DRAWINGS

The above and other aspects of the invention, its nature, and various features will become more apparent upon consideration of the following detailed description, taken in conjunction with the accompanying drawings, in which like reference characters may refer to like parts throughout, and in which.

DETAILED DESCRIPTION OF THE DISCLOSURE

At least one anti-rotational pin may be incorporated into an input component assembly to reduce or eliminate the ability for physical input elements, such as buttons, of electronic devices to be rotated. One or more pins may be positioned within a device between a button and at least one surface below the button in order to reduce or provide more control over the tendency for the button to rotate. When force is applied to the button, one or more pins can engage with one or more surfaces to aid in stabilizing, controlling, preventing, and/or reducing the tendency for the button to rotate.

In some embodiments, each pin may fit within a hole in one or more layers of material and/or in one or more components within the device to engage with a stable surface defining the hole.

Figure 1:
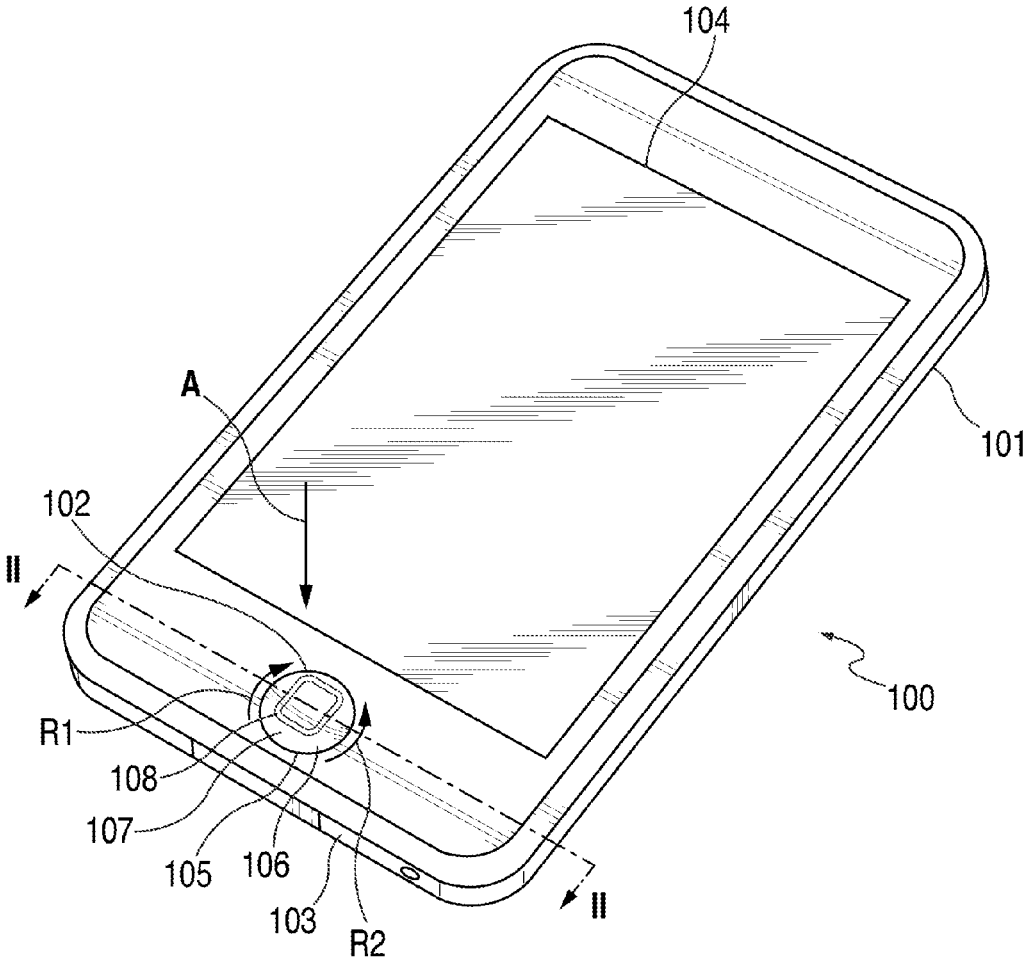
FIG. 1 is a perspective view of an exemplary electronic device with an input component assembly, in accordance with some embodiments of the invention.

FIG. 1 is a perspective view of an exemplary electronic device in accordance with some embodiments of the invention. Electronic device 100 can be any suitable device capable of receiving inputs through one or more input component assemblies, such as input component assembly 102. The term electronic device can include, but is not limited to, media players, video players, still image players, game players, music recorders, voice recorders, cameras, radios, medical equipment, domestic appliances, vehicle instruments, musical instruments, calculators, cellphones, wireless communication devices, personal digital assistants, programmable remotes, pagers, laptops, computers, printers, and/or any combination thereof. Electronic device 100 may have a single function or multiple functions.

In one or more embodiments, electronic device 100 may be any portable, mobile, hand-held, or miniature mobile electronic device. Miniature devices may have a form factor that is smaller than a hand held device, such as an iPod™ Shuffle available by Apple Inc. of Cupertino, Calif. Illustrative miniature devices may be incorporated into various objects that include, but are not limited to, the following: watches, rings, necklaces, belts, headsets, shoe accessories, virtual reality devices, other wearable electronics, sports or fitness equipment accessories, key chains, or any combination thereof. Alternatively, electronic device 100 may not be portable at all.

Electronic device 100 can include one or more additional components to create a user interface for device 100, some of which may be configurable to be controlled by one or more input assemblies of device 100. For example, electronic device 100 may include input component assembly 102 that can allow a user to manipulate at least one function of electronic device 100, one or more output component assemblies 104 (e.g., a display screen) that can provide the user with device generated information, and at least one protective housing 101 that can at least partially enclose a particular input component of input component assembly 102 and/or output component assembly 104.

As shown in FIG. 1, electronic device 100 can be hexahedral. Although, it should be noted that housing 101 is only exemplary and need not be substantially hexahedral. Housing 101 can be formed in any other shape, including, but not limited to, the following: spherical, ellipsoidal, conidial, octahedral, or any combination thereof, for example.

Input component assembly 102 may be a dome switch assembly or any other type of switch assembly that may have an actuator that may be depressed and/or deformed to close an otherwise open circuit of device 100, or to open an otherwise closed circuit. Input component assembly 102 may be made from any suitable material, including, but not limited to, metal, plastic, glass, and/or any combination thereof.

As shown in FIG. 1, input component assembly 102 may include a button 106 that may be positioned within or at least partially exposed through an opening 105 of housing 101. Button 106 is circular and fits within circular opening 105. Although depicted as circular, those with skill in the art will recognize that both button 106 and opening 105 can have a variety of shapes, such as square, rectangular, or any other shape. A top surface 107 of button 106 can have an icon 108 to indicate the location of button 106 and/or to represent functionality provided by button 106. For example, button 106 may be made from the same material and have the same color as housing 101 and icon 108 may allow a user to locate button 106 on device 100 and differentiate button 106 from housing 101.

Icon 108 can be any type of symbol, letter, numeral, text, shape, and/or any other representation or combination thereof. Icon 108 may be a representation of a functionality offered by device 100 and the functionality can be provided (e.g., instructions can be executed to provide functionality) when the user interacts with button 106. Button 106 may be positioned within device 100 to ensure that icon 108 is properly aligned relative to the other components of device 100. For example, as shown in FIG. 1, when icon 108 is properly aligned, each of the four sides for icon 108 may appear to run parallel to corresponding sides of device 100, and the curved edges of icon 108 may appear to be aligned with curved edges of device 100. In another example, icon 108 may be text and proper alignment of button 106 within device 100 may give the appearance that the text of icon 108 was written on an imaginary line running parallel to a bottom side 103 of device 100.

Continuing with FIG. 1, a force or pressure may be exerted by a user or an object in the direction of arrow A on top surface 107 of button 106 (e.g., in a direction perpendicular to a surface of housing 101 about button 106) and this pressure exertion may depress or deform an actuator of a switch that may be positioned below button 106 within housing 101 to actuate the switch. The switch may be positioned under the physical input element of input component assembly 102 (e.g., button 106) such that, when button 106 is depressed due to the user input force in the direction of arrow A, the switch may close an electrical circuit. In particular, a switch can include a dome that may be positioned over a contact pad such that, when the dome is deformed with the application of force in the direction of arrow A via button 106, the dome may come into contact with the contact pad and may close a circuit.

In order to prevent or reduce tendency for rotation of button 106 about a potential axis of rotation X (e.g., to prevent rotation in either rotation direction R1 or rotation direction R2) when force is applied to button 106, one or more features of button 106 may interact with one or more features of a fixed component within housing 101 and/or the housing 101 itself. Rotation may be prevented in order to maintain proper alignment of button 106 with respect to housing 101 or any other component of device 100 (e.g., to maintain proper alignment of icon 108 with respect to opening 105 and/or to maintain proper alignment of any other feature of button 106 with respect to any other feature of electronic device 100 (e.g., even if button 106 does not include an icon 108)).

Figure 2:
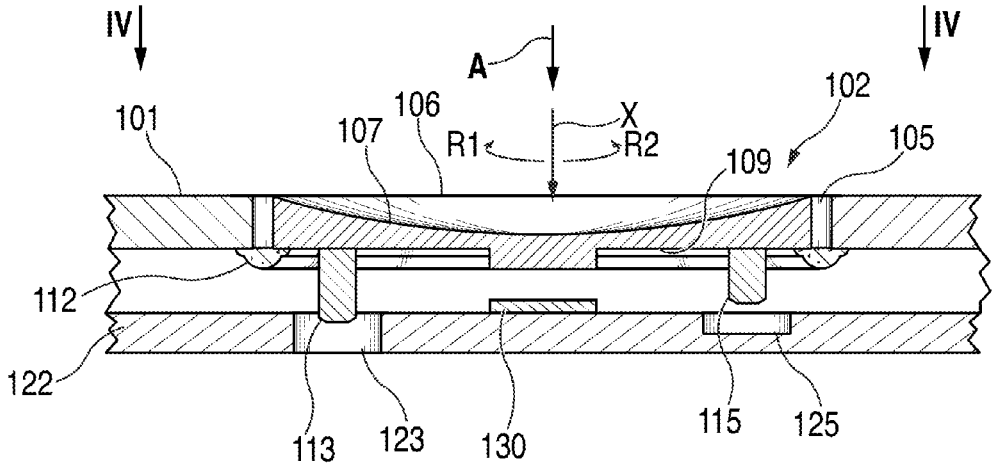
FIG. 2 is a cross-sectional view of a portion of the electronic device of FIG. 1, taken from line II-II of FIG. 1, before user activation, in accordance with some embodiments of the invention.
Figure 3:
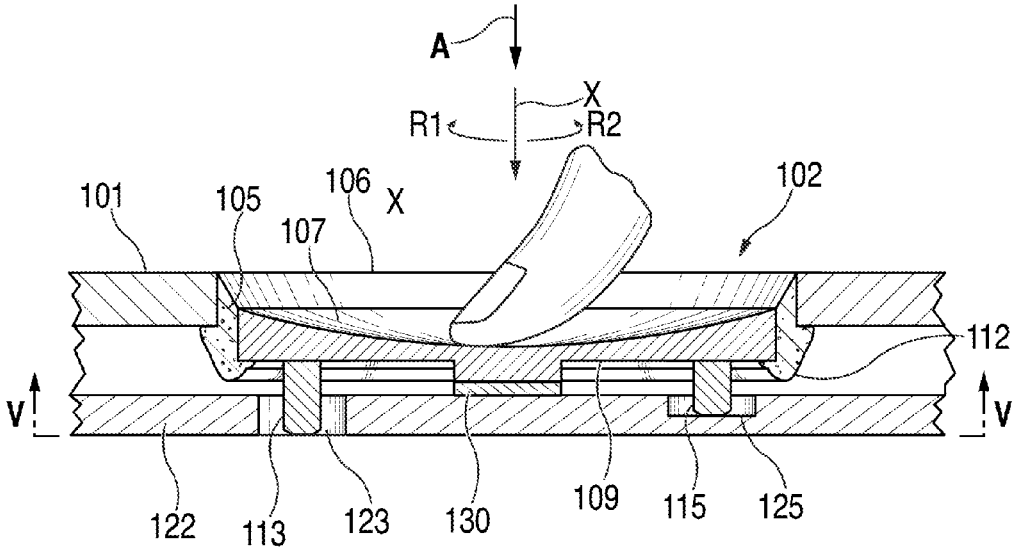
FIG. 3 is a cross-sectional view of the electronic device of FIGS. 1 and 2, similar to FIG. 2, during user activation, in accordance with some embodiments of the invention.

FIG. 2 is a cross-sectional view of a portion of the electronic device of FIG. 1, taken from line II-II of FIG. 1, before user activation, in accordance with some embodiments of the invention. FIG. 2 illustrates input component assembly 102 in a natural, undepressed state, prior to activation of a switch 130 due to an application of force in the direction of arrow A on top surface 107 of button 106. As shown in FIG. 2, one or more anti-rotational pins underneath button 106 may fit through one or more holes in one or more layers of material and interact with the material defining the hole in order to prevent rotation of button 106. A first mechanical engagement feature, such as an anti-rotational pin 113, may extend from a bottom surface 109 of button 106 and may engage a second mechanical engagement feature, such as a hole 123 that may be provided at least partially through any component of device 100, such as a frame 122. As shown in FIG. 2, pin 113 may extend at least partially into hole 123 of frame 122 when input component assembly 102 is in its natural, undepressed state. In some embodiments, anti-rotational pin 113 may be pushed further through hole 123 with depression of button 106 (e.g., in the direction of arrow A, as shown in FIG. 3). Additionally or alternatively, an anti-rotational pin 115 may extend from bottom surface 109 of button 106. However, unlike pin 113, pin 115 may not extend into a hole (e.g., hole 125 in frame 122) when input component assembly 102 is in its natural, undepressed state. Instead, anti-rotational pin 115 may only be pushed into hole 125 upon depression of button 106 (e.g., in the direction of arrow A, as shown in FIG. 3).

Holes 123 and 125 can be created in any number of components and/or surfaces of components of device 100 positioned below button 106 (e.g., beyond button 106 in the direction of a user input force, such as the direction of arrow A). Each hole may be sized to receive at least a portion of a pin when button 106 is depressed, and such that a surface defining the hole may interact with the pin to prevent motion of the pin when button 106 attempts to rotate (e.g., about axis X). As shown, anti-rotational hole 123 may be formed to allow anti-rotational pin 113 to go completely through a component (e.g., frame 122). Alternatively, hole 125 may be a recess or an indentation in a surface of a component, such as in a top surface of frame 122, and hole 125 may be formed by removing one or more layers of materials of frame 122.

Anti-rotational pins 113 and 115 may be attached to bottom surface 109 of button 106. Although illustrated as attached to button 106, anti-rotational pins 113 and 115 can be attached to any other surface at least partially below button 106, such as frame 122, a support plate for switch 130, a flexible circuit within device 100, or any other component of device 100. When anti-rotational pins 113 and 115 are engaged in one or more holes, anti-rotational pins 113 and 115 can stabilize button 106. Stabilizing can include, but is not limited to, the following: realigning a button, and/or reducing, eliminating, at least partially preventing, and/or providing a degree of control over rotation of button 106.

Anti-rotational pins 113 and 115 can prevent a tendency for an application of force to top surface 107 of button 106 to cause button 106 to rotate around a potential axis of rotation (e.g., potential axis X) or rotate about a pivot, such as using another component of device 100 as a pivot. For example, anti-rotational pins 113 and 115 can limit or control the use of another component or portion of a component of device 100 as a pivot for rotating button 106, such as about potential axis of rotation X in directions R1 or R2. By way of example, anti-rotational pins 113 and 115 may prevent, control, or limit a user's ability to apply a force on the outer edge of top surface 107 of button 106 and rotate button 106 about a pivot created by switch 130, such as a dome of a dome switch underneath button 106.

Anti-rotational pins 113 and 115 can work in conjunction with a gasket 112 to stabilize button 106. Gasket 112 can be designed and/or made from a material that allows gasket 112 to react to the application of force on button 106, similar to a spring, and assist in stabilizing button 106. Gasket 112 can be made from a material that yields and deforms to fill the space under button 106 to limit the ability for button 106 to rotate. Gasket 112 may create a fluid tight seal between housing 101 and button 106 to prevent fluid from entering device 100 through opening 105 in housing 101. Alternatively, anti-rotational pins 113 and 115 may provide the primary source of stability or anti-rotational assistance to button 106. For example, to protect a thinner gasket 112 from tearing when attempting to prevent rotation of button 106 (e.g., within opening 105), anti-rotational pins 113 and 115 may be designed to interact with surfaces defining holes 123 and 125 to prevent such rotation and to protect the integrity of gasket 112.

Anti-rotational pins 113 and 115 may be illustrated in FIGS. 2-5 as having a cylindrical shape. However, those with skill in the art will recognize that pins with an alternative shape can be used to reduce rotation of button 106, including, but not limited to, elliptical, conical, cubical, and/or any other three-dimensional shape or combination thereof. By way of example, anti-rotational pins can have cubical shape and engage with a surface that may define a circular shaped hole. Anti-rotational pins 113 and 115 may be formed to have a shape that allows the anti-rotational pin to be repeatedly subjected to applied forces and stabilize the button. Although anti-rotational pins are depicted throughout as having a substantially uniform thickness, those with skill in the art will recognize that anti-rotational pins can vary in thickness and shape. Anti-rotational pins 113 and 115 can have a uniform thickness throughout and/or the thickness of anti-rotational pins 113 and 115 can vary. For example, anti-rotational pins 113 and 115 may be thicker on the bottom face of the pin that engages with a surface defining a hole below button 106.

Anti-rotational pins 113 and 115 may interact with a surface that defines holes 123 and 125, respectively, that can engage anti-rotational pins 113 and 115 and prevent button 106 from rotating. Holes 123 and 125 may be any hole, recess, indentation, and/or cavity in any component of device 100. Any surface that defines one or both of holes 123 and 125 can engage anti-rotational pins 113 and 115 and can stop movement of anti-rotational pins 113 and 115 to prevent rotation of button 106.

Anti-rotational pins 113 and 115 can be made of any material, including, but not limited to, glass, plastic, metal, rubber, or any other material or combination thereof. Each pin may be flexible or rigid, and the rigidity of each pin may vary along its length.

Figure 5:
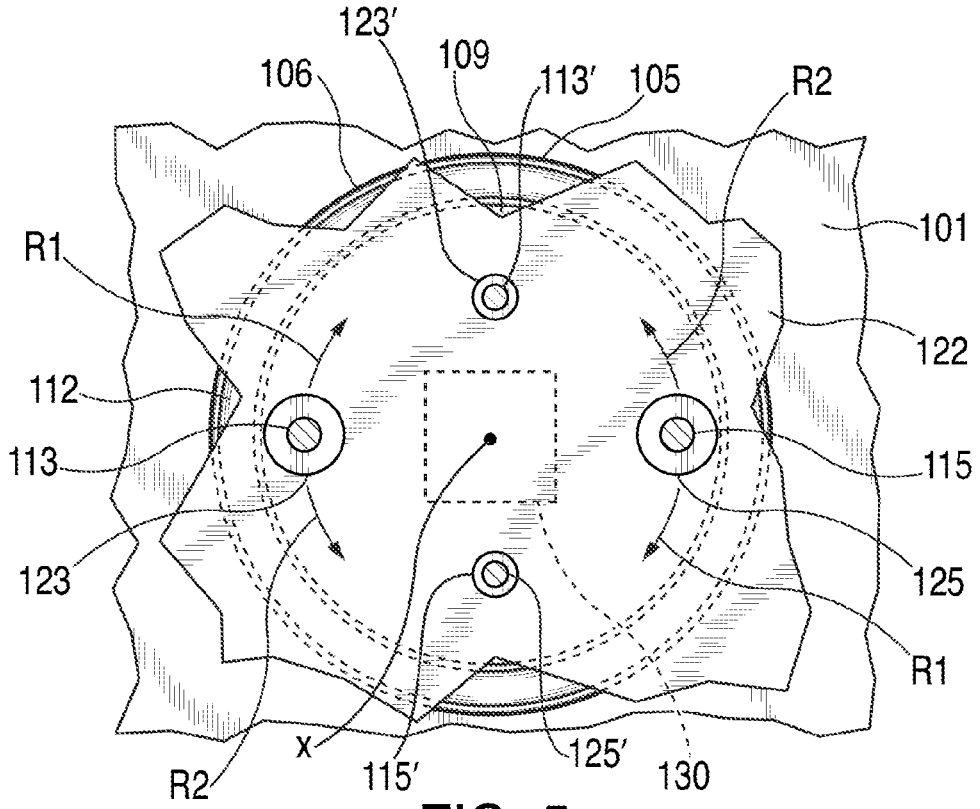
FIG. 5 is a bottom view of a portion of the electronic device of FIGS. 1-4, taken from line V-V of FIG. 3, in accordance with some embodiments of the invention.

Although anti-rotational pins 113 and 115 are shown positioned on either side of switch 130, any number of anti-rotational pins and any positioning of the pins can be utilized to stabilize button 106. Anti-rotational pins 113 and 115 can be put in locations to offer any degree of stability, control, and/or reduction in rotation of button 106 desired. For example, it may be desirable to use only one anti-rotational pin that is not linear with potential axis of rotation X in order to prevent rotation of button 106 about potential axis of rotation X (e.g., just pin 113, which may extend from button 106 in a direction parallel to axis X but offset from axis X). In another example, two pins on either side of potential axis of rotation X may be used (e.g., just pins 113 and 115 may be used). In another embodiment, four pins may be used that are equally spaced about potential axis of rotation X, such as pins 113 and 115, as well as pins 113' and pins 115' that may extend within holes 123' and 125', as shown in FIG. 5.

Some implementations may desire more allowance for rotation of button 106 and allow a user partially rotate button 106. For example, embodiments may provide larger sized holes 123 and 125 with respect to the size of pins 113 and 115 to delay engagement of a surface of the holes by anti-rotational pins 113 and 115, which may permit more rotation ability for button 106 before the interaction of the pins and holes prevent further rotation. In another example, anti-rotational pins 113 and 115 may fit snugly in holes 123 and 125 to ensure anti-rotational pins 113 and 115 almost always engage a surface of holes 123 and 125 to prevent even the slightest rotation of button 106. Holes 123 and 125 may be sized to prevent rotation when a relatively greater amount of force is applied to button 106 by varying the diameter of holes 123 and 125 (e.g., gradual shrinking of the diameter of hole 123 and 125) or when a relatively greater amount of force is applied to one side or particular location of button 106 (e.g., ensuring an anti-rotational pin is not centered in a hole such that the pin will engage with one surface of the hole when the button is rotated in one direction (e.g., R1) more quickly than the pin will engage with another surface of the hole when the button is rotated in another direction (e.g., R2)).

In some embodiments, anti-rotational pins 113 and 115 may be designed with varying heights and materials to control the amount that button 106 can rotate. Design of anti-rotational pins 113 and 115 and holes 123 and 125, respectively, may allow control over how much force is exerted and/or the speed at which the force is applied before rotation of button 106 is prevented. For example, shorter pin 115 may require more force in the direction of arrow A before anti-rotational pin 115 interacts with a surface defining hole 125 than a longer pin, such as anti-rotational pin 113. Continuing with the example, as a result, shorter anti-rotational pin 115 may provide more ability to rotate button 106 by virtue of anti-rotational pin 115 requiring more force exerted in the direction of arrow A before pin 115 may prevent rotation (e.g., by requiring enough force in the direction of arrow A on button 106 to depress pin 115 into hole 125).

Similarly, the design and size of holes 123 and 125 may allow more control over the amount that button 106 can rotate. For example, if anti-rotational pin 113 is formed from a yielding, deformable material, then deeper hole 123 surrounding a longer portion of pin 113 may require more force be exerted by pin 113 in a direction of rotation (e.g., R1 or R2) before pin 113 before releasing such a deformable pin than might a hole that surrounds a shorter portion of such a pin.

In one or more embodiments, any number of anti-rotational pins 113 and 115 may be used as a visual and/or mechanical guide for construction of device 100. Anti-rotational pins 113 and 115 can be attached to or incorporated into button 106 during formation of button 106. Anti-rotational pins 113 and 115 can be positioned to serve as a visual guide for alignment of icon 108 and/or button 106 with respect to device 100 when button 106 is initially positioned within opening 105 of housing 101. For example, pins 113 and 115 may be visible through holes 123 and 125 in frame 122 and the positioning of the pins may indicate how to position the button to properly align icon 108 with respect to device 100.

An approach to ensuring the proper positioning of button 106 and alignment of icon 108 during construction may be to use anti-rotational pin 113 on the underside of a button 106 as a mechanical and/or visual marker for positioning and alignment during construction. To ensure proper placement of button 106 with icon 108 within housing 101, anti-rotational pin 113 on the underside of button 106 may serve as a mechanical and/or visual guide for placement of button 106 and other parts of input component assembly 102 (e.g., frame 122) within housing 101 relative to button 106. For example, when a frame 122 is being lowered toward the outer housing 101 and button 106 of device 100 during construction, frame 122 can be placed over button 106 so that anti-rotational pin 113 is visible through one or more holes (e.g., hole 123) in frame 122. In this way, the visibility of anti-rotational pin 113 during construction ensures that icon 108 on the button 106 is straight and/or button 106 is properly placed over switch 130. If anti-rotational pin 113 is not visible or does not fit through hole 123 during construction, then button 106 may not be positioned correctly and icon 108 may be misaligned for an end user.

In some embodiments, gasket 112 may be positioned and adhered at least partially about button 106 and opening 105 of housing 101 to hold button 106 and housing 101 in place while frame 122 is being lowered toward housing 101.

FIG. 3 is a cross-sectional view of the electronic device of FIGS. 1 and 2, similar to FIG. 2, during user activation, in accordance with some embodiments of the invention. Force can be applied in direction A on to top surface 107 of button 106 to cause input component assembly 102 to be in an activated state, with a depressed button 106 that may activate switch 130 and close a circuit. In an activated/depressed state for input component assembly 102, gasket 112 may serve as a water tight seal to prevent fluid from coming through opening 105 between button 106 and housing 101. Gasket 112 may work in conjunction with anti-rotational pins 113 and 115 to help stabilize button 106 when force is applied from above in direction A. In some embodiments, gasket 112 may be relatively thin and may provide less assistance in stabilizing the button 106 than a thicker gasket. For example, a thinner gasket 112 may not expand to fill as much space under button 106 to assist in stabilizing button 106. In such cases where device 100 has a thinner gasket 112, anti-rotational pins 113 and 115 may be designed to offer relatively more stability for preventing rotation.

Anti-rotational pins 113 and 115 may be attached or coupled to bottom surface 109 of button 106 and/or button 106 may be manufactured to have anti-rotational pins 113 and 115 incorporated into button 106. During manufacture of button 106, icon 108 may be applied to top surface 107. Icon 108 may be positioned on top surface 107 relative to anti-rotational pins 113 and 115, such that anti-rotational pins 113 and 115 may serve as visual and/or mechanical indicators for proper alignment of icon 108 within housing 101. For example, icon 108 may be applied to top surface 107 relative to anti-rotational pins 113 and 115 to ensure that when anti-rotational pins 113 and 115 fit within holes 123 and 125 of frame 122, respectively, that icon 108 is straight and displayed properly to indicate location of button 106 and/or functionality of activated switch 130 for button 106.

As shown in FIG. 3, anti-rotational pins 113 and 115 may be positioned on either side of switch 130 of input component assembly 102 and on either side of potential axis of rotation X. Although input component assembly 102 is depicted in an activated state, it is not necessary for a circuit to be closed for anti-rotational pins 113 and 115 to engage with a surface that defines holes 123 and 125, respectively, to prevent or reduce tendency for rotation of button 106. For example, force may be applied in the direction A and prior to activation of switch 130, anti-rotational pins 113 and 115 may be at least partially within holes 123 and 125.

Anti-rotational pins 113 and 115 may be designed and positioned to handle force applied with any particular strength and/or at any particular location on button 106 to prevent rotation about potential axis of rotation X in directions R1 or R2. Engaged anti-rotational pins 113 and 115 can stabilize button 106 and reduce the tendency for button 106 to rotate. Anti-rotational pins 113 and 115 can limit, control, and/or prevent a tendency for an application of force on button 106 to cause button 106 to rotate when at least one of pin 113 and 115 engages with one or more surfaces that define at least one of holes 123 and 125, respectively.

As shown in FIG. 3 and by way of example, surfaces of frame 122 surround the bottom portion of anti-rotational pin 113 and may provide surfaces that define hole 123, and one or more of those surfaces that define hole 123 can engage or further engage anti-rotational pin 113. In another example, hole 125 may be defined by surfaces formed with by a recess in frame 122. In some embodiments, holes 123 and 125 may be in frame 122 that also supports switch 130 under button 106. Alternatively, holes 123 and 125 may be in any other suitable component of device 100 within housing 101 under button 106. Holes 123 and 125 may be provided through one or more components that are fixed in position relative to switch 130, housing 101, opening 105, button 106, and/or any other components that can provide surfaces that define holes 123 and 125 and do not move with rotation of button 106. As shown in FIG. 3, when a force is applied to button 106, pins 113 and 115 are able to extend within holes 123 and 125. When anti-rotational pins 113 and 115 are engaged, anti-rotational pins 113 and 115 stabilize button 106 and reduce the ability for the application of force to rotate button 106 about potential axis of rotation X in directions of rotation R1 and/or R2.

Figure 4:
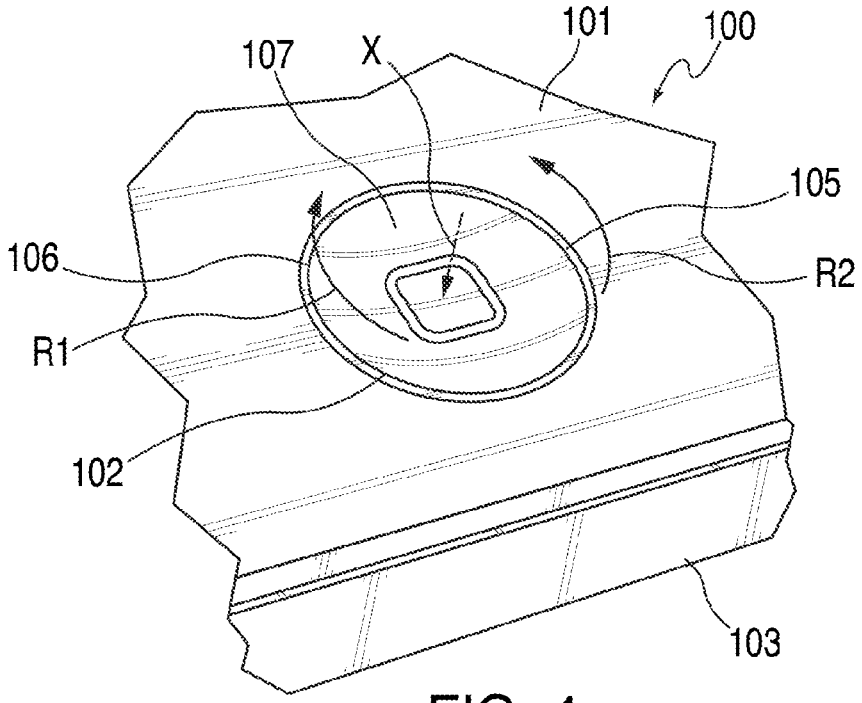
FIG. 4 is a top perspective view of a portion of the electronic device of FIGS. 1-3, taken from line IV-IV of FIG. 2, in accordance with some embodiments of the invention.

FIG. 4 is a top view of a portion of the electronic device of FIGS. 1-3, taken from line IV-IV of FIG. 2, in accordance with some embodiments of the invention. As shown in FIG. 4, button 106 of input component assembly 102 may sit within opening 105 in housing 101 of device 100. Icon 108 may be aligned within opening 105 such that the bottom of icon 108 may run parallel to bottom side 103 of device 100. Anti-rotational pins 113 and 115 beneath button 106 may serve to prevent or reduce the tendency for button 106 to rotate about potential axis of rotation X in either directions R1 or R2.

FIG. 5 is a bottom view of a portion of the electronic device of FIGS. 1-4, taken from line V-V of FIG. 3, in accordance with some embodiments of the invention. As shown in FIG. 5, beneath housing 101 of device 100 are anti-rotational pin 113 in hole 123 of frame 122 and anti-rotational pin 115 in hole 125 of frame 122. Anti-rotational pins 113 and 115 are on either side of switch 130 which may be above frame 122. In some embodiments, more than two pins (e.g., four pins 113, 113', 115, and 115') are shown in FIG. 5, at 0°, 90°, 180° and 270° around axis of rotation X) may be used to stabilize button 106. Gasket 112 can aid anti-rotational pins 113 and 115 in preventing rotation of button 106 in directions R1 and R2. Gasket 112 may also be coupled to button 106 and housing 101 to provide a water tight seal underneath opening 105 in housing 101 in which button 106 sits.

Figure 6:
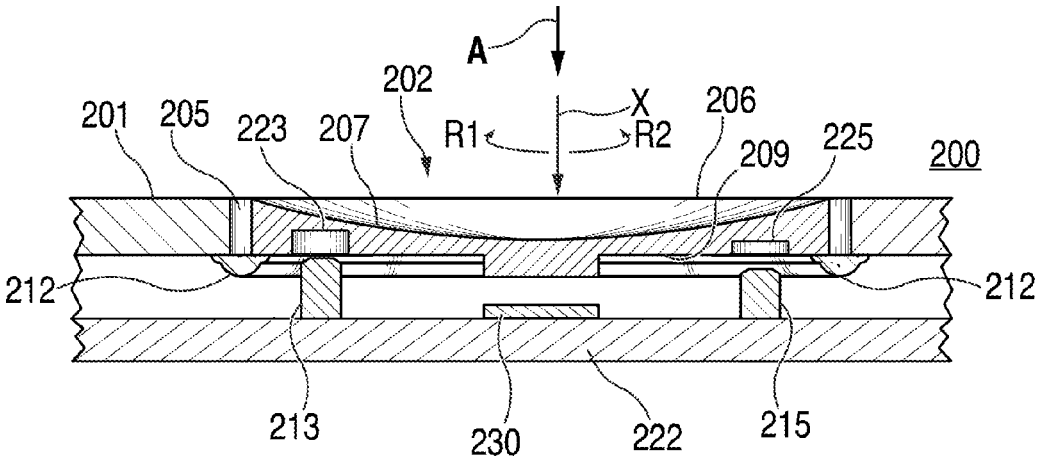
FIG. 6 is a cross-sectional view of a portion of an alternative embodiment of an electronic device with an input component assembly, similar to FIG. 2, before user activation, in accordance with some embodiments of the invention.

FIG. 6 is a cross-sectional view of a portion of an alternative embodiment of an electronic device with an input component assembly, similar to FIG. 2, before user activation, in accordance with some embodiments of the invention. FIG. 6 illustrates an input component assembly 202 of a device 200 in a natural, undepressed state, prior to activation of a switch 230 due to an application of force in the direction of arrow A on a top surface 207 of a button 206. Input component assembly 202 of device 200 may include anti-rotational pins 213 and 215 that may be attached to a frame 222 underneath button 206, and that may fit within holes 223 and 225 that may be provided in bottom surface 209 of button 206, respectively. When a force is applied at top surface 207 in the direction of arrow A, anti-rotational pins 213 and 215 may extend into holes 223 and 225, respectively, and may engage with one or more surfaces that define holes 223 and 225, respectively, to prevent or limit rotation of button 206 in either direction R1 or R2. Gasket 212 may be coupled to button 206 and housing 201 to serve as a water tight seal for opening 205 of housing 201 within which button 206 may be positioned. Gasket 212 may aid in preventing rotation in conjunction with pins 213 and 215 in some embodiments.

Figure 7:
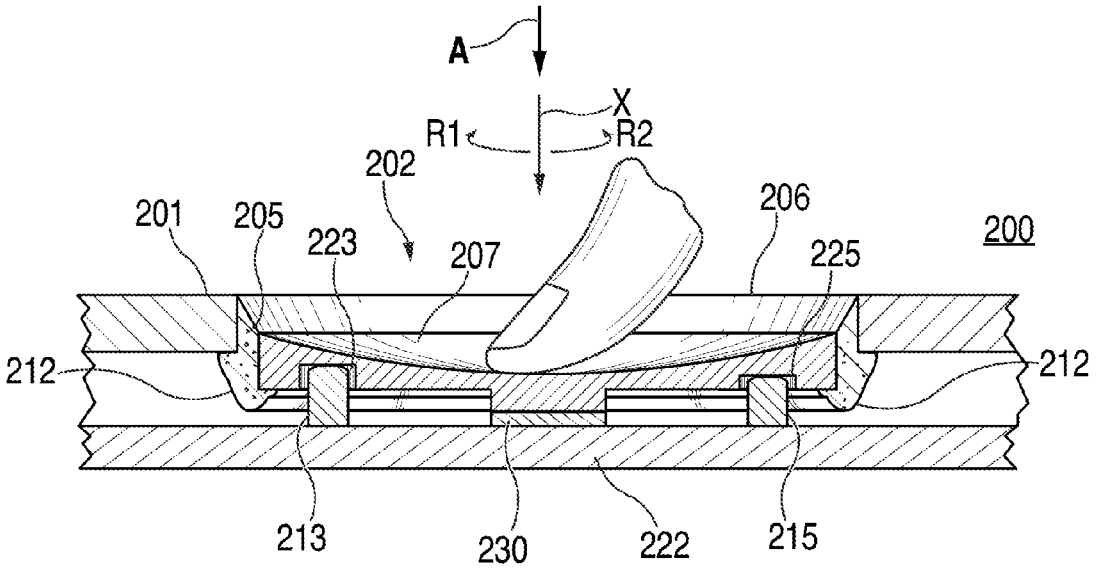
FIG. 7 is a cross-sectional view of the electronic device of FIG. 6, during user activation, in accordance with some embodiments of the invention.

FIG. 7 is a cross-sectional view of electronic device 200 of FIG. 6, during user activation, in accordance with some embodiments of the invention. Force can be applied in the direction of arrow A on to top surface 207 of button 206 to cause input component assembly 202 to be in activated state, with a depressed button 206 that may activate switch 230 and close a circuit. In an activated/depressed state for input component assembly 202, gasket 212 may serve as a water tight seal to prevent fluid from coming through opening 205 between button 206 and housing 201. Gasket 212 may work in conjunction with anti-rotational pins 213 and 215 to help stabilize button 106 when force is applied from above in direction A.

As shown in FIG. 7, anti-rotational pins 213 and 215 may be positioned on either side of activated switch 230 of input component assembly 202 and on either side of potential axis of rotation X. Although input component assembly 202 is depicted in an activated state, it is not necessary for a circuit to be closed for anti-rotational pins 213 and 215 to engage with a surface that defines holes 223 and 225, respectively, to prevent or reduce tendency for rotation of button 206. For example, force may be applied in the direction of arrow A and, prior to activation of switch 230, anti-rotational pins 213 and 215 may engage with surfaces that define holes 223 and 225 in button 206 to prevent rotation of button 206.

Figure 8:
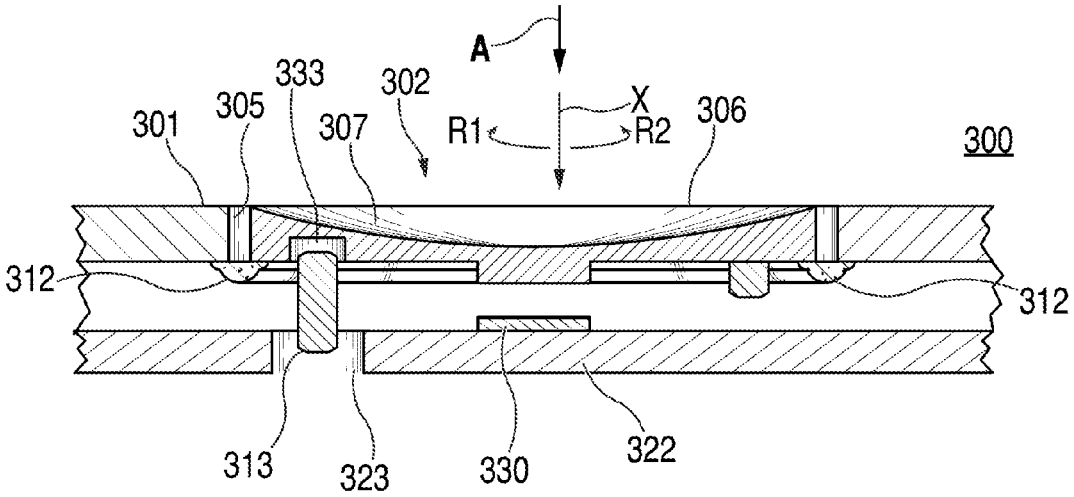
FIG. 8 is a cross-sectional view of a portion of another alternative embodiment of an electronic device with an input component assembly, similar to FIG. 2, before user activation, in accordance with some embodiments of the invention.

FIG. 8 is a cross-sectional view of a portion of an alternative embodiment of an electronic device with an input component assembly, similar to FIG. 2, before user activation, in accordance with some embodiments of the invention. FIG. 8 illustrates an input component assembly 302 of a device 300 in a natural, undepressed state, prior to activation of a switch 330 due to an application of force in the direction of arrow A on a top surface 307 of a button 306. Input component assembly 302 of device 300 may include an anti-rotational pin 313 that may be free-standing and unattached to a surface in device 300 (e.g., unattached to button 306 and unattached from a frame 322). Anti-rotational pin 313 may sit within a hole 323 within frame 322 and also within a hole 333 within button 306, at least when a force is applied in the direction of arrow A at top surface 307, or even when button 306 is not depressed. Engagement of pin 313 with surfaces defining holes 323 and 333 may prevent or limit rotation of button 306 in either direction R1 or R2. A gasket 312 may be coupled to button 306 and housing 301 to serve as a water tight seal for an opening 305 between housing 301 and button 306. Gasket 312 may aid in preventing rotation in conjunction with pin 313 in some embodiments.

Figure 9:
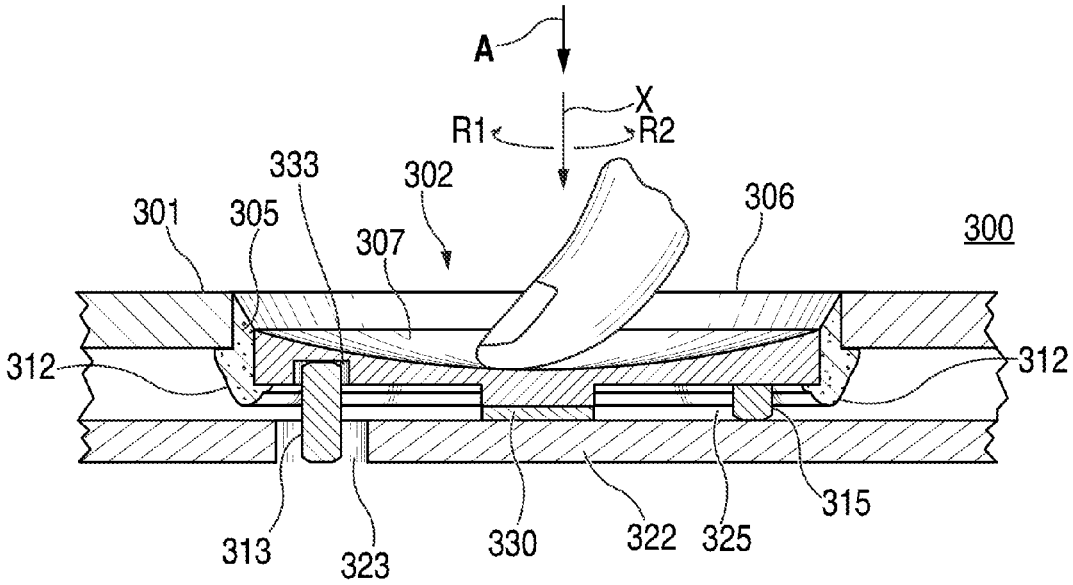
FIG. 9 is a cross-sectional view of the electronic device of FIG. 8, during user activation, in accordance with some embodiments of the invention.

FIG. 9 is a cross-sectional view of electronic device 300 of FIG. 8, during user activation of button 306, in accordance with some embodiments of the invention. Force can be applied in the direction of arrow A onto top surface 307 of button 306 to cause input component assembly 302 to be in an activated state, with a depressed button 306 that may activate switch 330 and close a circuit. In an activated/depressed state for input component assembly 302, gasket 312 may serve as a water tight seal to prevent fluid from coming through opening 305 between button 306 and housing 301. Gasket 312 may work in conjunction with anti-rotational pin 313 to help stabilize button 306 when force is applied from above in the direction of arrow A.

Figure 10:
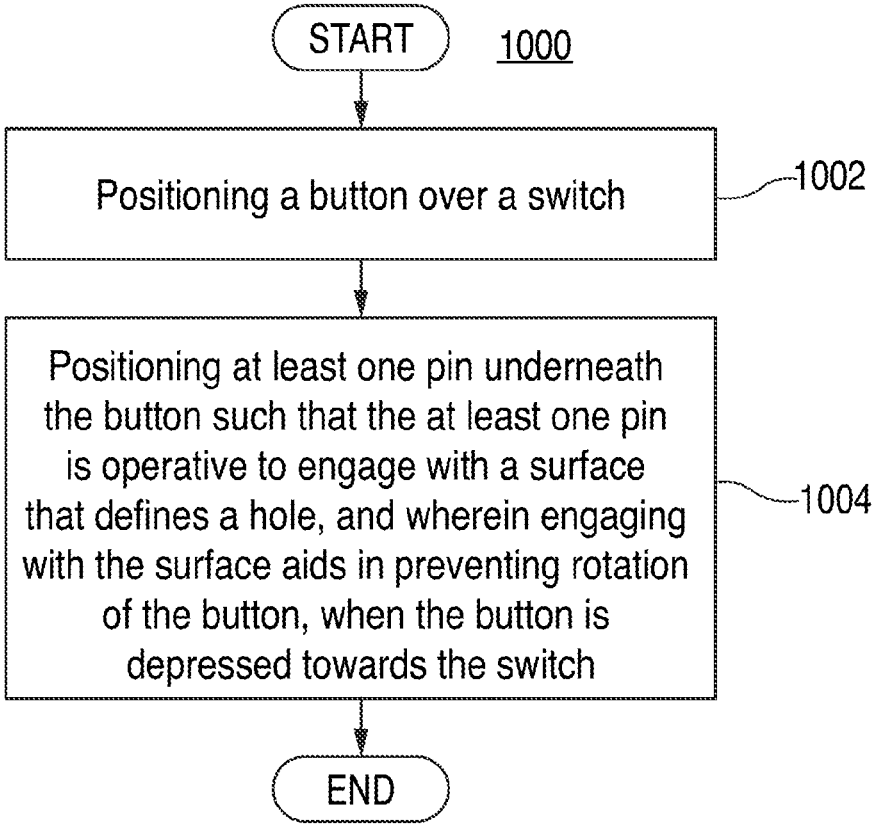
FIG. 10 is a flowchart of an illustrative process for forming an input component assembly, in accordance with some embodiments of the invention.

FIG. 10 is a flowchart of an illustrative process 1000 for forming an input component assembly, in accordance with some embodiments of the invention. At step 1002, a button (e.g., button 106) may be positioned over a switch (e.g., switch 130), such that the button may be operative to close at least one circuit of the switch when the button is depressed towards the switch 130.

At step 1004, at least one pin (e.g., pin 113 and/or pin 115) may be positioned underneath the button such that the at least one pin may be operative to engage with a surface that defines a hole (e.g., hole 123 and/or 125), and wherein engaging with the surface aids in preventing rotation of the button when the button is depressed towards the switch. One or more anti-rotational pins may be positioned underneath the button of the device to provide stability when force is applied to the button (e.g., a force to depress the button for operating the switch below the button). An anti-rotational pin may be physically coupled to the button (e.g., pin 113 and/or pin 115), free-standing within the device (e.g., pin 313), and/or coupled to any other surface of a component in the device (e.g., pin 213 and/or pin 215). In some embodiments, an anti-rotational pin may interact with a surface defining a hole in the button (e.g., hole 223, hole 225, and/or hole 333).

It is to be understood that the steps shown in process 1000 of FIG. 10 are merely illustrative and that existing steps may be modified or omitted, additional steps may be added, and the order of certain steps may be altered.

Figure 11:
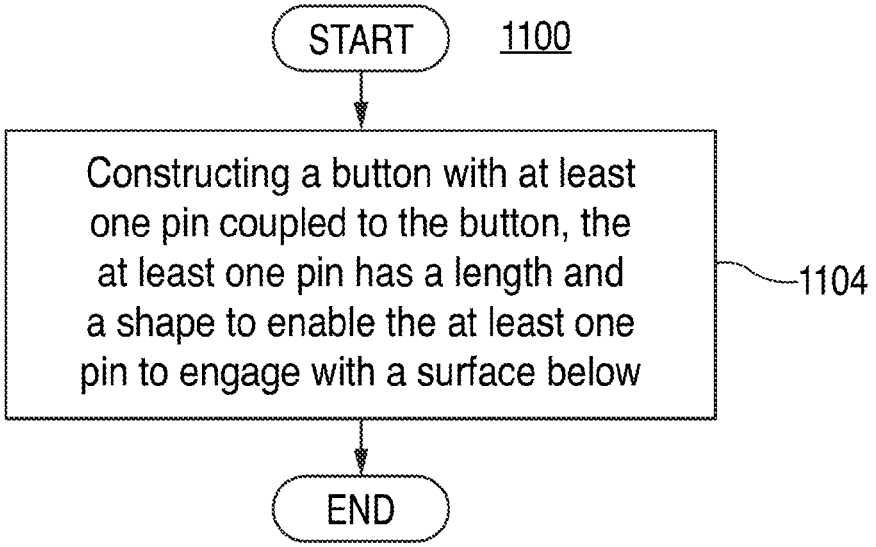
FIG. 11 is a flowchart of another illustrative process for forming an input component assembly, in accordance with some embodiments of the invention.

FIG. 11 is a flowchart of an illustrative process 1100 for forming an input component assembly, in accordance with some embodiments of the invention. A button may be constructed with at least one pin coupled to the underside of the button. Each anti-rotational pin can be formed to have a length and a shape to enable the pin to engage with a surface below the button. Several factors may determine the appropriate length of each anti-rotational pin including but, not limited to, the amount of space in the device between the button and the surface, the length required to engage with a surface defining a hole for limiting rotation of the button, the length required to allow rotation of button a desired amount, and/or any other factor.

Anti-rotational pins can be shaped to fit snugly within holes or have relatively more room to allow a desired amount of rotation before engaging with a surface defining a hole. Anti-rotational pins can be shaped differently than their respective hole. For example, anti-rotational pins can have a square shape and fit within a circular hole. Alternatively, anti-rotational pins can have the same shape as their corresponding hole.

Although FIGS. 1-9 have been described with respect to at least one pin extending into a hole and interacting with a surface of the hole in order to prevent rotation of a button, it is to be understood that any other set of engagement features other than a pin and a hole may be provided to prevent rotation of a button in accordance with other embodiments. For example, a first mechanical feature (e.g., at least one tooth) may engage with a second mechanical feature (e.g., at least one respective notch) to prevent rotation of a button, like the engagement of gear teeth. For example, rather than a pin 113 extending from bottom surface 109 of button 106 into a hole 123 in frame 122 for preventing rotation of button 106, a first mechanical feature of any other suitable type may extend from bottom surface 109 of button 106 and may engage with a second mechanical feature of any other suitable type within frame 122. As another example, rather than a pin 213 extending from frame 222 into a hole 223 within button 206 for preventing rotation of button 206, a first mechanical feature of any other suitable type may extend from frame 222 and may engage with a second mechanical feature of any other suitable type within button 206. A set of first and second mechanical features may be any suitable set of corresponding features that may engage with one another (e.g., when a button is depressed or even when a button is not depressed) to prevent rotation of the button about an axis of potential rotation.

While there have been described systems and methods for providing input component assemblies with anti-rotational buttons in electronic devices, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms such as "up and "down," "front" and "back," "top" and "bottom" and "side," "length" and "width" and "thickness," "X-" and "Y-" and "Z-," and the like are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention.

Therefore, those skilled in the art will appreciate that the invention can be practiced by other than the described embodiments, which are presented for purposes of illustration rather than of limitation.

What is claimed:

1. An input component assembly comprising:

a switch mounted on a surface;

a button positioned over the switch, wherein the button is operative to close at least one circuit of the switch when the button is depressed towards the switch;

a first pin associated with the button and engaging a first feature associated with the surface prior to the button being depressed, the first pin extending a first distance from the button;

a second pin associated with the button and engaging a second feature associated with the surface once the button is depressed towards the switch, the second pin extending a second distance from the button; wherein the first and second pins cooperate to restrict rotation of the button with respect to the surface.

2. The input component assembly of claim 1, wherein the first pin has a length that is operative to engage with the surface even when the button is not depressed towards the switch.

3. The input component assembly of claim 1, further comprising a frame that supports the switch, wherein the feature defines a hole in the frame.

4. The input component assembly of claim 1, wherein the surface defines a cavity within a device.

5. The input component assembly of claim 1, further comprising a gasket positioned at least partially about the button, wherein the gasket is operative to assist in preventing the rotation of the button.

6. The input component assembly of claim 1, wherein the first pin serves as a guide for alignment of an icon on the button with respect to another portion of the input component assembly.

7. The input component assembly of claim 1, wherein the first pin is attached to a bottom surface of the button.

8. The input component assembly of claim 1, wherein the first pin is attached to a frame, and wherein the surface defines a hole in the button.

9. An electronic device comprising:

a housing comprising an opening therethrough;

a surface fixed with respect to the housing;

a button positioned in the opening;

a first pin having a first length and configured to engage with a feature associated with the surface and the button prior to the button being depressed; and a second pin having a second length and associated with the button; wherein the second pin prevents rotation of the button in the opening only when the button is depressed toward the surface; and the first and second lengths are different.

10. The electronic device of claim 9, wherein the first pin has a length that is operative to engage with the surface even when the button is not depressed.

11. The electronic device of claim 9, further comprising:

a switch positioned within the housing below the button; and a frame that supports the switch, wherein the surface defines a hole in the frame.

12. The electronic device of claim 11, wherein the first pin is attached to the button.

13. The electronic device of claim 9, further comprising a gasket positioned at least partially about the button, wherein the gasket is operative to assist in preventing the rotation of the button.

14. The electronic device of claim 9, wherein the first pin serves as a guide for alignment of an icon on the button with respect to another portion of the electronic device.

15. The electronic device of claim 9, wherein the first and second pins are attached to a bottom surface of the button.

16. The electronic device of claim 9, wherein the first pin is attached to the surface, wherein the button comprises a hole, and wherein the first pin engages with a surface of the button defining the hole.

17. A method for forming an input component assembly for an electronic device, the method comprising:

positioning a button over a switch, wherein the button is operative to close at least one circuit of the switch when the button is depressed towards the switch;

positioning a first pin underneath the button, wherein the first pin is operative to engage with a surface that defines a hole prior to the button being depressed; and positioning a second pin between the button and the surface;

wherein the second pin prevents rotation of the button only when the button is depressed towards the switch.

18. The method of claim 17, wherein the positioning of the first pin comprises physically coupling the first pin to the underside of the button.

19. The method of claim 17, wherein the positioning of the first pin comprises physically coupling the first pin to a frame underneath the button.

20. The method of claim 17, wherein the first pin serves as a visual guide for alignment of an icon on the button with respect to another portion of the input component assembly.

21. An input component assembly comprising:

a switch;

a button positioned over the switch, wherein the button is operative to close at least one circuit of the switch when the button is depressed towards the switch;

a first mechanical feature positioned underneath the button and engaging a second mechanical feature prior to the button being depressed; and an anti-rotational pin positioned underneath the button;

wherein the anti-rotational pin is operative to engage with the second mechanical feature to assist in preventing rotation of the button only when the button is depressed towards the switch.

22. The input component assembly of claim 21, wherein the first mechanical feature is operative to engage with a second mechanical feature even when the button is not depressed towards the switch.

23. The input component assembly of claim 21, further comprising a frame that supports the switch, wherein the frame comprises the second mechanical feature.

24. The input component assembly of claim 21, wherein the first mechanical feature comprises at least one tooth, and wherein the second mechanical feature comprises at least one notch formed in a surface.

25. The input component assembly of claim 21, wherein the first mechanical feature is on a bottom surface of the button, and the second mechanical feature is on a top surface of a frame.

26. The input component assembly of claim 25, wherein the first mechanical feature comprises at least one tooth extending from the bottom surface of the button, and wherein the second mechanical feature comprises at least one notch extending into the top surface of the frame.

27. The input component assembly of claim 25, wherein the first mechanical feature comprises at least one notch extending into the bottom surface of the button, and wherein the second mechanical feature comprises at least one tooth extending from the top surface of the frame.

* * * * *